US005437513A

United States Patent [19]

Favre

[11] Patent Number: 5,437,513

[45] Date of Patent: Aug. 1, 1995

[54] COSMETIC CONTAINER CONSTRUCTION

[75] Inventor: Bernard Favre, Sceaux, France

[73] Assignee: Lir France, Chevilly-Larue, France

[21] Appl. No.: 214,385

[22] Filed: Mar. 17, 1994

[30] Foreign Application Priority Data

Mar. 29, 1993 [FR] France ..... 93 03619

[51] Int. Cl.[6] ..... A45D 40/06; A45D 40/16

[52] U.S. Cl. ..... 401/68; 401/75; 401/79; 401/175

[58] Field of Search ..... 401/68, 75, 79, 175

[56] References Cited

U.S. PATENT DOCUMENTS

| | | | |
|---|---|---|---|
| 4,363,560 | 12/1982 | Gentile | 401/68 |
| 4,514,102 | 4/1985 | Ackerman et al. | 401/75 |
| 4,545,696 | 10/1985 | Carluceio | 401/75 |

FOREIGN PATENT DOCUMENTS

| | | | |
|---|---|---|---|
| 720266 | 10/1965 | Canada | 401/79 |
| 70257 | 1/1983 | European Pat. Off. | 401/175 |
| 0387213 | 9/1990 | European Pat. Off. . | |
| 0391862 | 10/1990 | European Pat. Off. . | |
| 2556941 | 6/1985 | France | 401/75 |
| 2573734 | 5/1986 | France . | |
| 3118893 | 11/1982 | Germany | 401/68 |
| 249752 | 7/1947 | Switzerland | 401/75 |

*Primary Examiner*—Steven A. Bratlie
*Attorney, Agent, or Firm*—Steinberg, Raskin & Davidson

[57] ABSTRACT

A dispensing packing for stick-shaped pasty products which is made from synthetic material and includes a hollow body inside of which the pasty stick is guided in the longitudinal direction, a device for displacing the stick formed of a sliding piston to which the stick is connected and of a screw for displacing the piston, a drive cap for rotating the screw mounted at one end of the body opposite to the closure cap of this body. The body has on the one hand an internal jacket defining both longitudinal ends of the body and made from a resiliently deformable material compatible with the pasty product as well as an external case partially surrounding the jacket and assembled to the latter. The packing is intended for the conditioning of sanitary or cosmetic products such as deodorants or lipsticks.

12 Claims, 3 Drawing Sheets

1
8
V
X
833
825
5
53
35
835
433
36
6
431
3
4
62
61
2
II
II
63
N
437
366
627
47
93
762
7
III
III
27
X'

COSMETIC CONTAINER CONSTRUCTION

BACKGROUND OF THE INVENTION

The present invention relates to a dispensing packing for stick-shaped pasty products with a stationary external barrel or case for the decoration of the body.

Various types of dispensing packings for stick-shaped pasty products, goods or wares such as cosmetic products, adhesives or the like are known. For a long time, these packings are essentially made from plastics or synthetic material.

Nowadays it is frequent that such a dispensing packing comprises a hollow body inside of which a pasty stick is guided in a longitudinal direction between a retracted position and a position of use projecting from a first end of the body. Inside of the body is provided a device for the displacement of a stick, which consists of a sliding piston to which the stick is made fast and of a screw adapted to co-operate with the piston for moving it (and therefore for displacing the stick) in the longitudinal direction. A drive cap for rotating the screw is mounted at the other so-called "second end" of the body whereas the first end may be closed by a cap.

It moreover is usual that the piston comprises ports opening opposite to both ends of the body and that a tightness system, most often consisting of an interposed disposable capsule be provided between the first end of the body and the closure cap. It is thus possible to provide the stick directly within the packing by using the hollow body as a mold. More specifically the stick is obtained from the second end of the body by casting the selected product in the fluid state through the openings of the piston and then by solidifying this product inside of the body prior to the mounting of the drive cap owing to which the second end is closed generally.

This kind of packing of the prior art however exhibits many inconveniences. In particular it is difficult with the known packings to find for the body a material which meets in an economically acceptable manner both the mechanical requirements and the requirement of compatibility with the product of the pasty stick. Likewise with the packings of the prior art it is not easy to differentiate the aspect of the dispensing packing in accordance with the pasty product it contains. In other words except for providing different hollow bodies for a same type of packing, which is very expensive, all these packings are substantially identical irrespective of the pasty product they contain.

Still another major inconvenience of the packings of the prior art consists in that the device for moving the stick, i.e. the screw and the displacement piston should be mounted inside of the body through its first end. This increases in a useless manner the number of operating steps required for the assembling of the packing.

In addition the tightness systems of the known packings which consist generally of an inserted part like a capsule are not always perfectly effective for the casting of the stick and increase the cost price of the packing as well as the number of operating steps necessary to its assembling.

Furthermore the tightness system of the known packings should be withdrawn from the body before the first use of the stick, thereby being often felt as a wearisome operation by the consumer. Once withdrawn the tightness system is of course thrown away into trash independently of the remainder of the packing so that the recycling of the whole materials which constitute the latter may not be carried out simultaneously. Therefore once the tightness system has been withdrawn, the stick of pasty product has the tendency to become quickly altered mainly through evaporation of the volatile elements such as alcohols, water etc . . . contained within the pasty product of the stick.

OBJECT AND SUMMARY OF THE INVENTION

Therefore the object of the present invention is to provide an economic dispensing packing for a stick of pasty product which copes among others with the inconveniences of the prior art referred to hereinabove.

For that purpose the subject of the invention is a dispensing packing essentially made from synthetic material for a stick-shaped pasty product such for example as a deodorant or lipstick and of the type comprising a hollow body inside of which the pasty stick is guided in a longitudinal direction between a retracted position and a position of use projecting from a first end of the body, a device for displacing the stick consisting of a sliding piston to which the stick is made fast and of a screw adapted to co-operate with the piston for moving the latter in the said direction, a drive cap for rotating the screw mounted on the other or second end of the body as well as a cap for closing the first end, a tightness system being provided between the closure cap and the body whereas the piston comprises apertures opening opposite to both ends of the body so that the stick is obtained from the second end of the body by casting the product through the apertures and solidification within the body prior to the mounting of the drive cap, characterized in that the body comprises on the one hand an internal jacket or sleeve which defines both longitudinal ends and which is made from an elastically deformable material compatible with the pasty product and a stationary external barrel or case partially surrounding the jacket and of the other hand integrated means for assembling the case with the internal jacket or sleeve.

According to another characterizing feature, the inner jacket or sleeve comprises a surface of revolution formed in the material and arranged in front of the second end of the body whereas the aforesaid drive screw which is inserted into the packing through this end is caused to bear in the said direction and is guided in rotation against this surface of revolution of the jacket or sleeve.

Preferably the aforesaid tightness system comprises a lip which forms the first end of the inner jacket or sleeve and is adapted to be accommodated in sealed relationship while deforming itself into a groove of corresponding shape of the closure cap when the latter is in the position of closing the body of the packing.

Moreover the aforesaid tightness system may be provided as comprising between the first end and the external case at least one peripheral protrusion made integral in one piece of material with the inner jacket as well as a corresponding surface of the closure cap upon which the protrusion is caused to be tightly pressed while deforming itself when the cap is in the position of closing the body of the packing.

According to still another characterizing feature of the invention the internal jacket or sleeve comprises near its first end a threading with which co-operates a tapped threading of the aforesaid closure cap so that at the end of being screwed, i.e. in the closing position, the latter exerts upon the jacket a force approximately directed towards the second end of the body.

Advantageously the integrated assembling means comprise on the one hand at least one device for positioning the jacket and holding it against motion with respect to the external case and on the other hand at least one device for the fastening through resilient clasping or "clipping" of the jacket and of the said case.

The invention is also characterized in that the guiding edges of the piston and of the stick made integral in one piece of material with the internal jacket are projecting in nearly parallel relation to the aforesaid longitudinal direction and those ends of these edges which are opposite to the closure cap preferably forming the aforesaid surface of revolution guiding the drive screw.

According to the embodiment illustrated, the outer case of the body is made from a rigid material such as a styrenic plastic material or a metal and may comprise ornamental elements such for example as printings, transparent portions, inlays, embossings or raised parts or the like.

It should also be pointed out here that the case may have near its end opposite to the cap another surface of revolution adapted to guide the drive cap in rotation with respect to the body of the packing.

In this case the inner jacket of the body will preferably comprise near the second end at least one sealing collar or peripheral ring-shaped fin or rib adapted to be pressed while deforming itself elastically against the inside of the drive cap.

It is moreover possible that the aforesaid drive cap and the displacement screw have dog elements made integral in one piece of material and in mutual engagement with each other in order to connect the said screw to the drive cap for unitary rotation therewith.

BRIEF DESCRIPTION OF THE DRAWINGS

The invention will be better understood and further objects, characterizing features, advantages and details thereof will appear better from the following explanatory description with reference to the accompanying diagrammatic drawings given by way of non-limiting example only and illustrating a presently preferred specific embodiment of the invention and in which.

DETAILED DESCRIPTION OF THE INVENTION

Referring to the figures there is seen a dispensing packing 1 for any stick-shaped pasty product. According to the illustrated example the packing 1 is provided for a sanitary cosmetic product such as a deodorant. However any other pasty product applicable in the same manner and for example in the field of the cosmetics, of medicine, of pottering, of food or the like may also be conditioned in a packing similar to 1.

Figure 1:
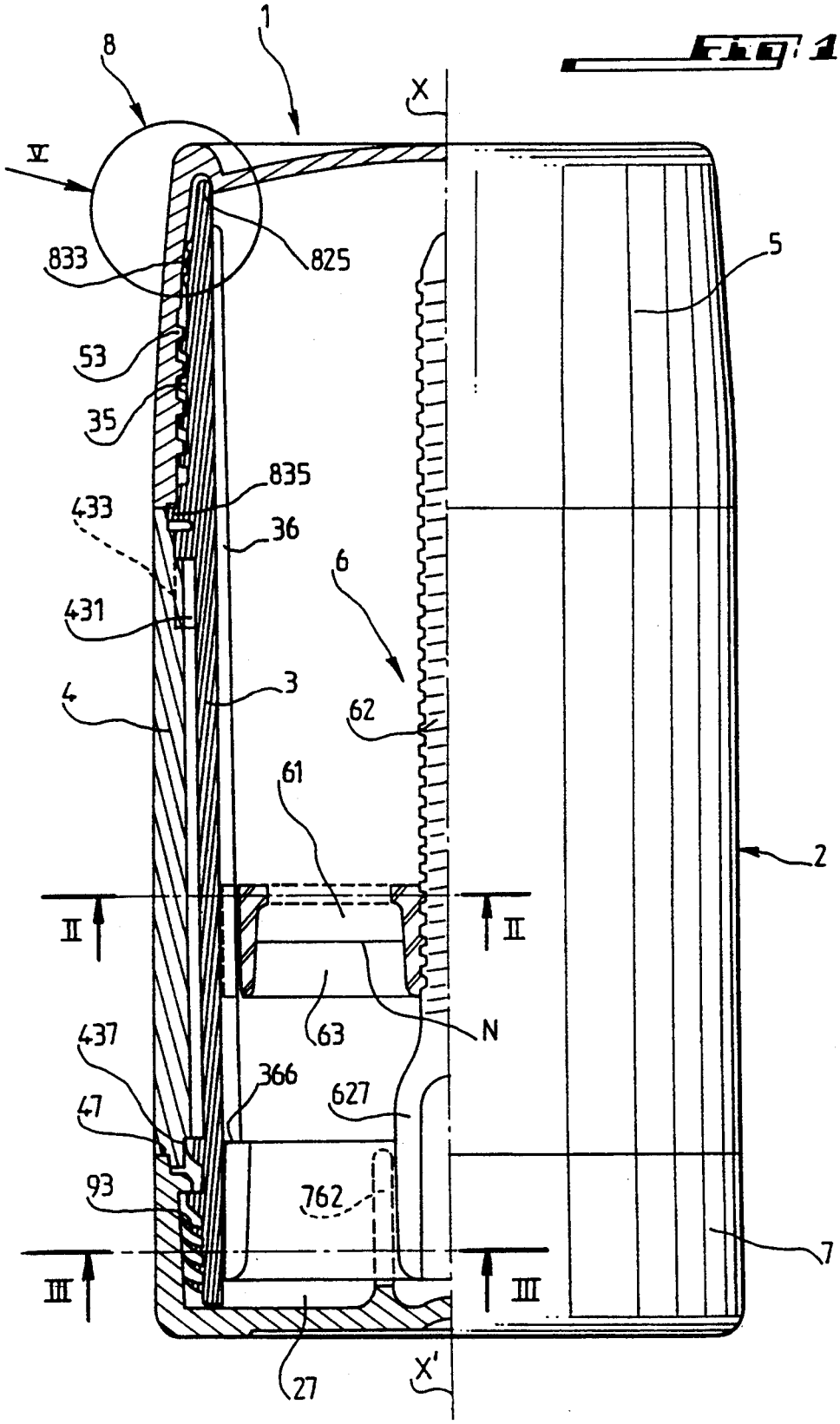
FIG. 1 is an elevational view partially in section of a dispensing packing according to the invention.
Figure 2:
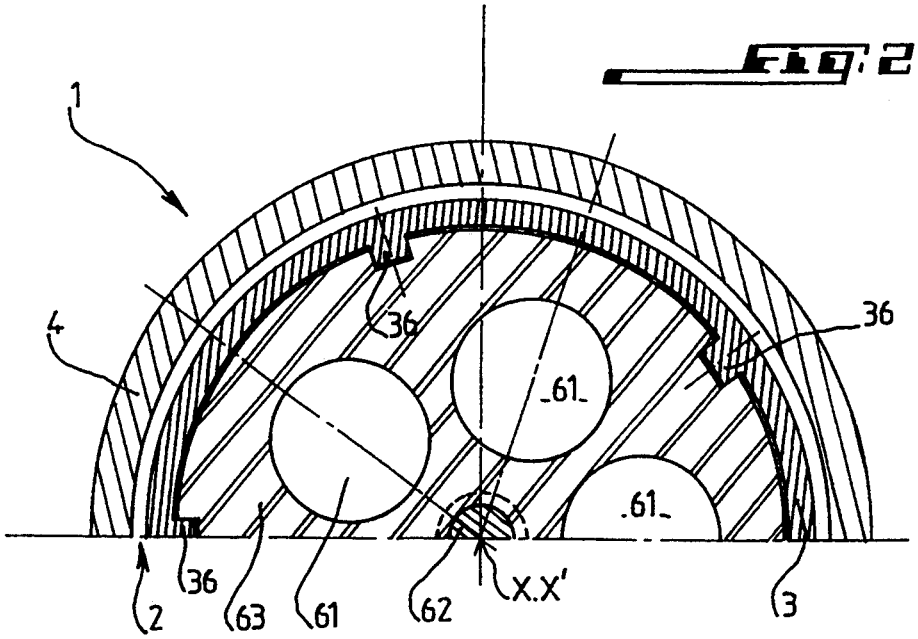
FIG. 2 is a view in cross-section taken upon the line II—II of FIG. 1 through the piston of the packing.
Figure 3:
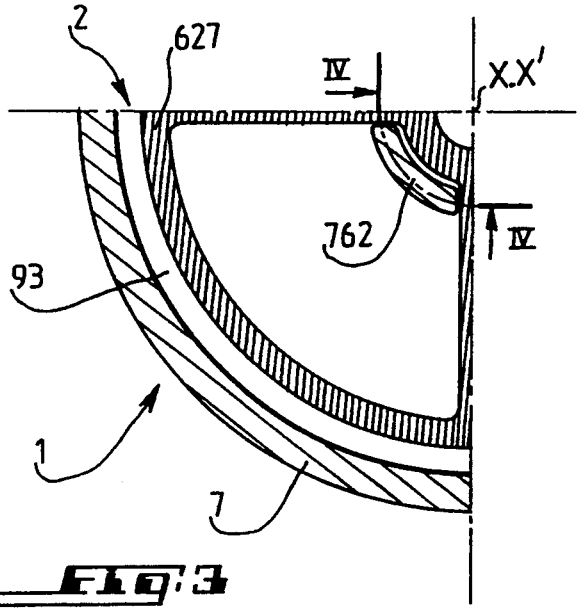
FIG. 3 is a view in cross-section taken upon the line III—III of FIG. 1 through the second end of the packing.

This packing 1 comprises a hollow body 2 the longitudinal direction of which is parallel to an axis X-X' as seen on FIGS. 1, 2 and 3. Here the hollow body 2 has a nearly cylindrical shape the axis X-X' of which forms the center. It is however perfectly possible that the hollow body 2 has an oval, oblong, polygonal or any other shape also moreover permitting a good gripping of the packing 1.

The hollow body 2 should of course define an internal space into which the stick of pasty product may be caused to be slidingly housed, i.e. to be guided in the direction X-X' which also forms the central and longitudinal axis of this stick. Thus the stick of pasty product is displaceable in translatory motion in the direction X-X' between a position retracted into the inside of the body 2 and a position of use projecting from a first end 825 of the body 2. This end 825 located at the top of FIG. 1 defines a so-called top opening of the internal space limited by the hollow body 2. The second end of the body 2, i.e. its bottom end is opposite in the direction X-X' to the end 825 and is designated at 27 on FIG. 1.

This second end 27 of the body is closed by a cup-shaped cap 7 the cross-section perpendicular to the axis X-X' corresponds substantially to that of the body 2. This cap (FIGS. 1 and 3) is mounted onto the body 2 so that it may be rotated with respect to the latter about the axis X-X'. The cap 7 allows to operate a device 6 for the displacement of the stick between its retracted position and its position of use in either direction.

More specifically the cap 7 is made fast to for rotation with a screw 62 of the device 6 and drives the latter when it is actuated. The displacement screw 62 is arranged inside of the body 2 in the direction X-X' and extends substantially from the lower end 27 to the upper end 825 of the latter. When considering FIGS. 1 and 2, it is understood that the device 6 also comprises a piston 63 the shape of which corresponds substantially to that of the inner space defined by the body 2 in order to be displaced in sliding relationship in the direction X-X' inside of the latter. This piston 63 is made fast to for rotation and sliding with the stick of pasty product. It is already understood that owing to the device 6 when the screw 62 is turned with the assistance of the cap 7, the piston 63, which is held against rotation with respect to the body 2, moves the stick of pasty product in sliding relationship along the axis X-X' in a direction corresponding to the direction of rotation of the screw 62.

Figure 5:
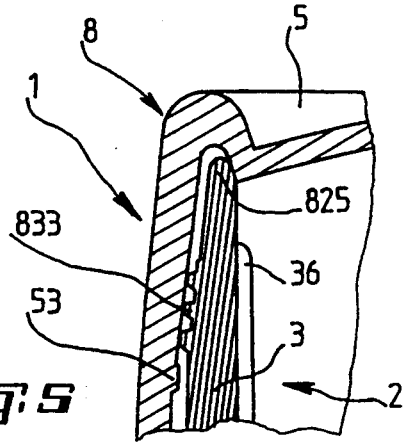
FIG. 5 is a partial view of a detail of the tightness system of the packing of FIG. 1.

On FIGS. 1 and 5 it is seen that the first end 825 of the body 2 may be closed by means of a plug or cap 5. Like the drive cap 7, the closure cap 5 has the shape of a cup or cover but the concavity of which is opposite to that of the drive cap. The closure cap 5 may indeed be mounted onto the body 2 in order to close its end 825 wherefrom the pasty stick may project when the packing 1 is used.

It should also be pointed out on FIGS. 1 and 2 that the piston 63 comprises apertures 61 which open each one opposite to both longitudinal ends 825 and 27 of the body 2 of the packing. In other words the internal space defined by the body 2 is divided at right angles to the axis X-X' by the piston 63 and both portions of this inner space are communicating with each other through the openings 61.

The packing also comprises a tightness system 8 provided between the closure cap 5 and the body 2. Owing to this tightness system and to the openings 61, when the packing 1 is placed upside down, i.e. with the first end 825 directed downwards, that portion of the internal space of the body 2 which extends from the first end 825 to the piston 63 may be used as a mold for making the stick by casting through the openings 61 of a fluid which after solidification converts itself into a stick of the selected pasty product. The line perpendicular to the axis X-X' seen on FIG. 1 and designated at N shows the filling level of this fluid inside of the packing 1. When considering the level N it is understood that the stick fills at least partially up the ports or openings 61 of the piston 63 which preferably have a shape flared towards the second end 27 of the body 2. Thus the stick of pasty product is made fast to both for rotation and sliding in the direction X-X' with the piston 63. After the filling for instance by means of one or several flexible nozzles with a diameter smaller than that of the openings 61 and therefore adapted to extend into the inner space where the stick is molded, it is clear that the second end 27 of the body 2 is closed with the assistance of the drive cap 7.

According to the invention the body 2 comprises on the one hand an inner sleeve or jacket 3 and on the other hand a stationary outer barrel or case 4. The inner jacket 3 of the body 2 which combines the essential functional elements of the packing 1 is projecting in the direction of the axis X-X' from the case 4 and therefore defines both longitudinal ends 825 and 27 of the body 2. For its part the external case 4 which partially surrounds the internal jacket 3 forms the stationary portion of the packing which is taken by the hand of the user when the latter actuates the drive cap 7. Owing to this structure peculiar to the invention the outside of the body 2, i.e. the case 4 may be easily provided with ornamental elements such for example as printings, transparent parts, inlays, raised portions or the like whereas the internal part, namely the jacket 3 is made from a resiliently deformable material compatible with the pasty product forming the stick conditioned within the packing 1. Moreover protrusions and recesses of suitable shapes are made integral in one piece of material with the internal jacket 3 and the case 4 to form integrated means for assembling both component elements of the body 2.

According to the illustrated example which relates to a packing for a labial cosmetic product such as a lipstick, the inner jacket 3, the sliding piston 63 as well as the displacement screw 62 are made from a synthetic or plastics material such as polypropylene for example. As to the external case 4, to the closure cap 5 and to the drive cap 7, the latter are preferably made from a rigid material such as a styrenic plastic of suitable aspect and mechanical strength. Other materials may of course also be used for the external parts (4, 5 and 7) of the packing 1 such in particular as acrylo-nitrile styrene or polymers such as polystyrene and in particular the one which is designated under the usual name ABS. Likewise wood or metal may be used for the external parts of the packing 1. Similarly it is not compulsory to make the internal jacket 3 from polypropylene and the latter may be obtained by molding of polymethyloxide (POM) or the like.

The different elements of the packing 1 illustrated on the figures will now be described. It is understood when considering FIG. 1 that the aforesaid tightness system 8 does not consist here of a part interposed between the closing cap 5 and the body 2 but comprises a lip made integral in one piece of material with the inner jacket 3 and which forms the first end 825 thereof. The lip 825 extends over the whole periphery of the jacket 3 so as to be able to be accommodated in sealing relationship while deforming itself into an annular groove of corresponding shape of the cap 5 when the latter is in the position of closing the body 2. The position of closing the body 2 by the cap 5 is the one which is illustrated in particular on FIG. 1 and corresponds to a full engagement of the cap 5 with the body 2. It is understood when referring in particular to FIG. 5 that when the cap 5 is withdrawn from the body 2, the peripheral end lip 825 which is made from an elastically deformable material and which projects in the direction X-X' from the external case 4 is in a rest position in which it is not arranged exactly in front of the annular groove of the cap 5 but slightly inwards of the internal space defined by the body 2. It should also be noted that the annular groove of the cap 5 has a shape flaring towards the second end of the packing 1 so that the lip 825 is radially deformed outwards when it moves inside of the annular groove thereby having the effect of tightly pressing its peripheral internal surface against a corresponding surface of the external periphery of the annular groove of the cap 5.

As stated hereinabove the tightness system 8 moreover comprises between the first end 825 and the rigid case 4 at least one peripheral or radial protrusion made integral in one piece with the jacket 3 as well as a corresponding surface of the closure cap 5 onto which each protrusion is caused to be tightly pressed while deforming itself when the cap is in the position of closing the body 2.

Referring to FIGS. 1 and 5 it is seen that according to the illustrated embodiment several radial protrusions or rings 833 made integral in one piece with the jacket 3 are projecting as rings extending along planes, respectively, perpendicular to the axis X-X' of the external surface of this jacket which comprises the lip 825. The peripheral radial rings 833 which here are in a number of three are indeed projecting from an external substantially frusto-conical surface of the jacket 3 the diameter of which decreases towards the lip 825. The closure cap 5 comprises a surface of corresponding shape which extends inside of the latter between the annular groove with which the end lip 825 cooperates and an internal tapped threading 53 owing to which the cap 5 may be screwed onto the body 2.

More specifically that portion of the jacket 3 which projects from the external case 4 and which comprises the lip 825 includes a threading 35 with which the tapped threading 53 of the closure cap 5 co-operates. The tapped threading 53 and the threading 35 as well as the free peripheral edge of the cap 5 are arranged so that at the end of the screwing, i.e. in the closing position, the cap 5 exerts upon the jacket 3*a* force approximately directed towards the second end 27 of the body 2. This allows not only to obtain the above-mentioned deformations of the lip 825 and of the ring-shaped protrusions 833 against the corresponding surfaces of the cap 5 but also to provide for a good holding in the position of closing the packing 1.

The force exerted by the cap 5 in the closing position or in the position at the end of the screwing step is also effective to compensate for the manufacturing tolerances of the packing 1. It is indeed seen on FIG. 1 that in the closing position the free peripheral end of the cap 5 is caused on the one hand to bear against a corresponding end of the rigid case 4 (to obtain a uniform outer aspect of the packing 1) as well as against an annular protrusion 835 of the jacket 3 which projects therefrom along a plane perpendicular to the axis X-X'. A peripheral recess is formed below the protrusion 835, which projects along the axis X-X', of the above-mentioned end of the case 4 when the cap is not mounted onto the body 2. Thus at the end of the screwing of the cap 5, the peripheral lower end of the latter is caused to bear against and elastically deforms the annular protrusion 835 of the jacket 3 so that the latter would move towards the recess which is formed underneath it. Such a flexible bearing of the cap 5 against the annular protrusion 835 further improves the fluid-tightness between the body 2 and the cap 5 but above all permits the compensation for the manufacturing clearances and the holding thereof against motion in the closing position.

Referring now to FIG. 2 there is seen that the internal jacket 3 comprises as radially projecting inwards of the space defined by the body 2, a plurality of ridges or ribs 36 made integral in one piece of material; These ridges 36 which extend in nearly parallel relation to the axis X-X' are here in a number of five and are regularly distributed over the internal periphery of the jacket 3. Each one of the ridges 36 of the jacket 3 is caused to be accommodated within a groove of corresponding shape of the piston 63 in order to guide the latter along the axis X-X'. Likewise the illustrated piston 63 comprises five filling ports or holes 61 the cross-section of each one of which at right angles to the axis X-X' is substantially circular and which are arranged so that on a same radius of the piston 63 be formed either a filling opening 61 or a longitudinal groove for one ridge 36. It is obvious when considering in particular FIGS. 1 and 2 that these longitudinal ridges 36 which cooperate with the grooves of the piston 63 also allow the latter as well as the stick of pasty product to be held against rotation.

It should be noted here that according to the illustrated embodiment the end 27 of the body 2, i.e. its end opposite to the closure cap 5, the ridges 36 of the jacket 3 define a surface of revolution 366 owing to which as it will be explained further the displacement screw 62 is held against motion axially and guided in rotation with respect to the body 2.

The integrated means for assembling the internal jacket 3 and the external case 4 will now be described. As this appears well from FIG. 1 these assembling means comprise on the one hand at least a device for positioning and holding immovable the jacket 3 with respect to the case 4 (as it is seen in particular on the broken away portion of FIG. 1) and on the other hand at least one device for fastening through resilient clasping or "clipping" 437.

Figure 1A:
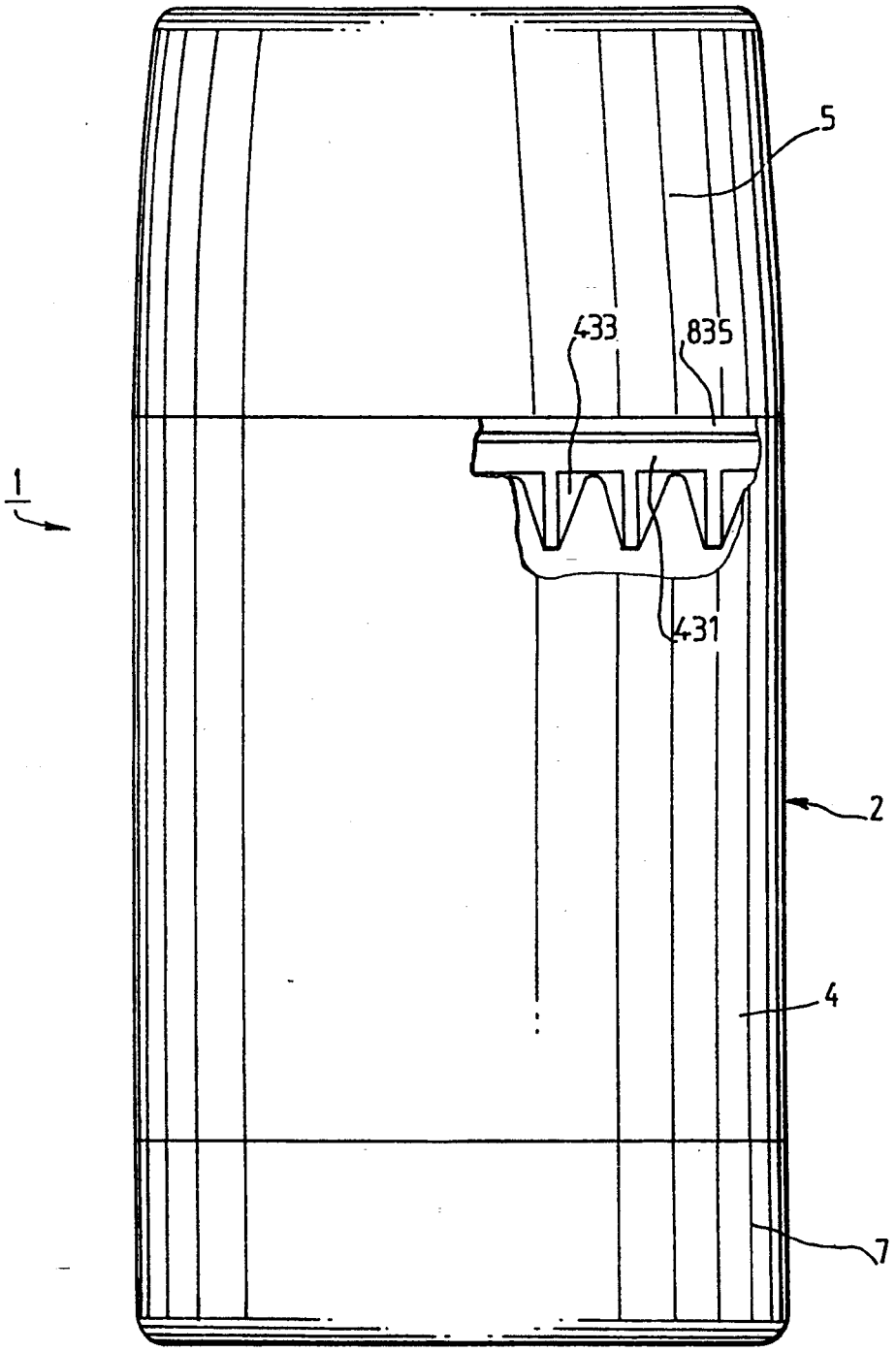
FIG. 1A is a view of the dispensing packing according to the invention as shown in FIG. 1 with parts broken away.

As shown in FIG. 1A, the illustrated device for positioning and holding immovable the packing 1 comprises portions 431 of the sleeve or jacket 3 projecting outwards thereof as well as corresponding recesses 433 formed inside of the case 4. The protruding portions 431 are each one "T-" shaped the vertical leg of which is nearly parallel to the axis X-X' and the cross bar of which is perpendicular to this axis. In fact the transverse bars of the projecting portions 431 of the jacket 3 are joined to each other and form an annular peripheral protrusion above which extends the protrusion 835 described hereinabove as well as the recess towards which the latter deforms itself when the closure cap 5 is mounted onto the body 2. The concave portions 433 with which the projecting portions 43 1 of the jacket 3 are co-operating have the shapes of tapered crenels or of a "V". As this appears well from FIG. 1, the free end of each leg parallel to the axis X-X' of the projecting portions 431 is caused to bear upon the body of a V-shaped concave portion 433 when the case 4 is mounted along the axis X-X' about the jacket 3. It is obvious that this mounting of the case 4 is carried out by engaging the case 4 with the jacket 3 by the second end 27 (or bottom end) of the latter. It is understood that this engagement of the case 4 with the jacket 3 is possible until the concave portions or recesses 433 are abutting against the projecting portions 431. Owing to this fact the portions 43 1 and 433 are operating as axial stops along the axis X-X' and are also holding the jacket 3 against rotation with respect to the case 4. The resilient clasping or "clipping" of the jacket 3 onto the case 4 by means of the devices 437 should of course be effected before the portions 431 and 433 are abutting against each other. According to the illustrated embodiment the clipping device 437 comprises a plurality of projecting catches made integral in one piece of material with a jacket, a corresponding recess of the case 4 co-operating with each one of them. It is seen on FIG. 1 that the clipping devices 437 are provided at that end of the case 4 which is opposite to the portions 433, i.e. at its end which is closest to the second end 27 hence to the drive cap 7.

It should be noted here that this cap 7 is itself also mounted onto the body 2 through displacement along the axis X-X' towards the closure cap 5. More specifically the drive cap 7 is displaced along the axis X-X' towards the closure cap 5 until its free peripheral end is caused to bear against a corresponding peripheral end surface 47 of the external case 4. The peripheral bottom end 47 of the case 4 here defines a surface of revolution adapted to guide in rotation and to hold against motion, in the direction X-X', the drive cap 7 with respect to the body 2. Here the surface 47 comprises a portion nearly perpendicular to the axis X-X' as well as a centering shoulder but could of course have any other suitable shape such for example as a frusto-conical shape tapering towards the end 27. It is moreover seen on FIG. 1 that near the device 437 the jacket 3 comprises other outwards projecting catches. These other catches co-operate with a corresponding ridge of the drive cap 7 and allow the latter to be fastened through elastic clasping onto the jacket 3 hence onto the body 2. This resilient clasping onto the jacket 3 of the drive cap 7 is of course effected before the latter abuts against the guiding surface 47 of the external case 4.

On FIGS. 1 and 3 there is seen that between the device 437 and the lower end 27, the jacket 3 comprises at least one peripheral external collar, fin or rib designated by the reference numeral 93. In fact, the illustrated jacket 3 comprises four annular collars or fins or peripheral ribs 93 each one of which is caused to press while being deformed elastically against the inside of the drive cap 7 when the latter is mounted onto the body 2. When considering FIG. 1, it clearly appears that these peripheral ribs 93 have the purpose of isolating in fluid-tight relationship with respect to the outside the internal space defined by the body 2 at the level of its lower end 27. In other words owing to the sealing fins 93, the drive cap 7 closes in sealed relationship the second end 27 of the body 2 when it is mounted onto the latter.

But prior to the mounting of the drive cap 7, it is necessary to insert the displacement device 6 into the inside of the body 2. In fact the longitudinal screw 62 and the piston 63 are preferably assembled by screwing whereafter the device 6 thus formed is inserted into the body 2 from the second end 27. It should be noted here that contrary to all the equivalent packings of the prior art, the packing 1 according to the invention makes possible an assembly of all its elements and parts in the same direction, i.e. towards its closing cap 5.

Figure 4:
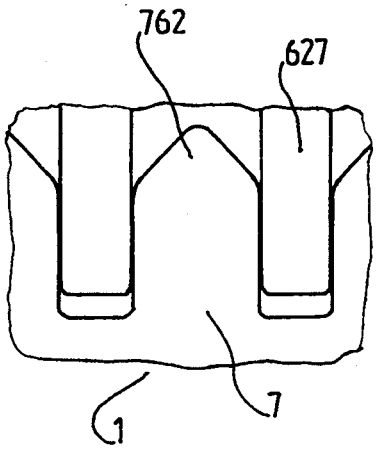
FIG. 4 is a partial view in section taken upon the line IV—IV of FIG. 3.

From FIGS. 1, 3 and 4 it is understood that the screw 62 comprises at its end opposite to the closure cap 5 a portion 627 made integral in one piece of material and approximately wheel-shaped (see FIG. 3). This wheel is caused to be accommodated with play upon the mounting of the device 6 into the body 2 inside of a cylindrical portion of the jacket 3 which extends from the surface of revolution 366 formed by the mentioned ridges 36 down to the second end 27 of the body 2. Thus for the mounting of the device 6, the grooves of the piston 63 are engaged in the direction X-X' by the longitudinal ridges 36 until a suitable surface of the wheel 627 of the screw 62 is caused to bear upon the surface of revolution 366 of the jacket 3 which for that purpose is disposed in front of the end 27. In this way the screw 62 is positioned along the axis X-X' and is guided in rotation by the surface of revolution 366 consisting of the ends of the ridges 36. Although on FIG. 1 the guide surfaces between the jacket 3 and the screw 62 are extending nearly at right angles to the axis X-X', it is also possible that the latter be directed differently and for example be frusto-conical.

It is also owing to the wheel 627 of the screw 62 that the latter may be made fast to for rotation with the drive cap 7. Now it is seen on FIG. 3 that this wheel 627 comprises solid spikes which extend radially from the screw 62 proper towards a ring-shaped portion of the wheel 627 through the medium of which the latter cooperates with the jacket 3. These solid spikes define not only the apertures which are opening on the one hand opposite to the apertures 61 of the piston 63 and on the other hand in front of the end 27 of the body 2 in order to permit the filling of the latter during the making of the pasty stick by molding but also form dogging elements which are caused to come in engagement with the elements 762 of the drive cap 7. These dogging elements of the drive cap 7 are as it is seen on FIG. 4 in the shape of teeth made integral in one piece of material. More specifically the dogging teeth 662 which extend approximately in the direction X-X' from the inside of the concavity of the drive cap 7 have an arcuate shape (FIG. 3) and a free end defining an inverted V. Each dogging element or tooth 762 of the drive cap 7 is caused to become accommodated in the direction X-X' between two solid spikes of the wheel 627 and near a central portion or hub of the wheel 627 when the drive cap 7 is mounted onto the unit consisting of the body 2 and the device 6. Then each tooth 762 is inserted between two solid spikes of the wheel 627 of the screw 62, the latter being made fast to for rotation through dogging with the drive cap 7.

The operation of the packing 1 which has just been described is the same as that of the corresponding packings of the prior art. In other words when the closure cap is withdrawn and the user holds the external case 4 of the body 2 in his hand, any rotation in either direction of the drive cap 7 causes a displacement along the axis X-X' of the pasty stick in the corresponding direction.

There has thus been provided according to the invention a dispensing packing owing to which an outstanding fluid-tightness is achieved without the interposition of any separate part between the closure cap and the body 2 the structure of which is particularly simple and easy to be assembled. The assembling of the packing 1 indeed consists in fastening the jacket 3 onto the case 4, in assembling the body 2 thus formed to the closure cap 5 and then in inserting into this body the displacement device 6. Then in particular owing to the fluid-tightness achieved with the assistance of the portions 825,833 and 835 described hereinabove, the pasty stick may be obtained by molding within the internal space of the body 2, whereafter the second end 27 of the latter may be closed owing to the sealed mounting (peripheral ribs 93) of the drive cap 7. It should again be emphasized here that with respect to the closure cap 5, the jacket 3, the case 4, the device 6 and the drive cap 7 are all mounted in the same direction, i.e. from bottom to top on FIG. 1, thereby making the assembly of the packing according to the invention very quick and simple.

The invention is of course not at all limited to the embodiment which has just been described and comprises all the equivalents and all the combinations of the technical means illustrated if the latter are carried out according to its gist and within the scope of the appended claims.

What is claimed is:

1. In a dispensing packing for stick-shaped pasty products such as deodorants or lipstick, including an elongate hollow body having first and second opposed ends and an interior for receiving a pasty stick, means for moving the stick in a longitudinal direction of said body between a retracted position in which the stick is contained with said body and a position of use in which the stick projects from said first end of said body, said means including a sliding piston connected to the stick, a screw adapted to cooperate with said piston for moving said piston in said longitudinal direction and a drive cap for rotating said screw, said piston comprising through passages such that the pasty stick is molded in said body upon solidification of stick constituting product cast into said body through said passages from said second end of said body prior to mounting of said drive cap, a closure cap for closing said first end of said body, and a tightness system arranged between said closure cap and said body, the improvement comprising;

said body comprises an elongate internal jacket formed from a material compatible with the pasty stick product, said internal jacket comprising a tubular shell having open, opposed longitudinal ends, a stationary external case comprising a rigid material surrounding said internal jacket such that ends of said internal jacket extend beyond said external case and constitute said first and second ends of said body, and assembly means for fixedly coupling said internal jacket to said external case, said screw having a main portion and an end portion arranged closer to said second end of said body, said end portion of said screw having a diameter larger than the diameter of said main portion and including through passages for enabling casting of the product within said body, said end portion of said screw being rotatably supported on a surface of said internal jacket, said drive cap being coupled to said end portion of said screw and mounted on said second end of said body to close said second end of said body and thus a respective one of said open, longitudinal ends of said internal jacket, said drive cap and one end of said internal jacket comprising respective locking means for locking said drive cap to said end of said internal jacket while allowing rotation between said drive cap and said internal jacket, whereby upon rotation of said drive cap with respect to said external case and said internal jacket, said piston is displaced relative to said body.

2. A packing according to claim 1, wherein the inner jacket comprises a surface of revolution made integral in one piece of material and arranged in facing relation to the second end of the body whereas the aforesaid drive screw which is inserted into the packing through this end is caused to bear in the said direction and is guided in rotation against this surface of revolution of the jacket.

3. A packing according to claim 1, wherein said tightness system comprises a lip forming a first end of said internal jacket and adapted to be tightly received upon deformation within an annular groove of corresponding shape arranged in said closure cap when said closure cap closes said first end of said body.

4. A packing according to claim 3, wherein said tightness system further comprises at least one peripheral protrusion integral with said internal jacket and arranged between said first end of said internal jacket and said external case, and a corresponding surface to said at least one protrusion, said corresponding surface being arranged on the inner face of the closure cap such that said at least one protrusion is pressed in sealed relationship with said corresponding surface upon deformation when said closure cap closes said first end of said body.

5. A packing according to claim 1, wherein the internal jacket comprises near its first end a threading with which co-operates a tapping of said closure cap so that at the end of the screwing, i.e. in the closing position, the latter exerts upon the jacket a force approximately directed towards the second end of the body.

6. A packing according to claim 1, wherein the aforesaid assembling means comprise on the one hand at least one device for positioning and holding against motion the jacket with respect to the external case and on the other hand at least one device for the fastening through resilient clasping or "clipping" of the jacket and of the said case.

7. A packing according to claim 2, wherein ridges for guiding the piston and the stick, made integral in one piece of material with the internal jacket are projecting in nearly parallel relation to said longitudinal direction, those ends of these ridges which are opposite to the closure cap preferably forming said surface of revolution for the rotary guiding of the screw of the displacement device.

8. A packing according to claim 1, wherein the external case of the body is made from a rigid material and comprises ornamental elements such as prints, transparent portions, inlays and raised parts.

9. A packing according to claim 2, wherein the stationary external case has close to its end opposite to the closure cap another surface of revolution adapted to guide in rotation the drive cap with respect to the body of the packing.

10. A packing according to claim 1, wherein the internal jacket of the body comprises near the second end at least one peripheral sealing collar or rib adapted to be pressed in fluid-tight relationship while being resiliently deformed upon the inside of the drive cap.

11. A packing according to claim 1, wherein said drive cap and the displacement screw have dogging elements made integral in one piece of material and in mutual engagement so as to make said screw fast to for unitary rotation with the drive cap, these elements being preferably located near the axis of rotation of said screw.

12. A packing according to claim 1, wherein said external case is connected to said internal jacket to prevent relative movement between said internal jacket and said external case.

* * * * *